United States Patent [19]

Tanaka et al.

[11] Patent Number: 4,472,496

[45] Date of Patent: Sep. 18, 1984

[54] PROCESS FOR PREPARING SILVER HALIDE EMULSION

[75] Inventors: Shigeo Tanaka; Kaoru Onodera, both of Odawara, Japan

[73] Assignee: Konishiroku Photo Industry Co., Ltd., Tokyo, Japan

[21] Appl. No.: 454,871

[22] Filed: Dec. 30, 1982

[30] Foreign Application Priority Data

Jan. 14, 1982 [JP] Japan ..... 57-5194

[51] Int. Cl.[3] ..... G03C 1/28

[52] U.S. Cl. ..... 430/542; 430/603; 430/543

[58] Field of Search ..... 430/603, 542, 543

[56] References Cited

U.S. PATENT DOCUMENTS 2,222,264 11/1940 Nietz et al. ..... 430/603
2,521,926 9/1950 Lowe et al. ..... 430/603
4,088,494 5/1978 Tani ..... 430/603
4,097,284 6/1978 Tani ..... 430/603

*Primary Examiner*—Won H. Louie
*Attorney, Agent, or Firm*—Frishauf, Holtz, Goodman & Woodward

[57] ABSTRACT

There is disclosed a process for producing a silver halide emulsion comprising sulfur sensitizing a silver halide emulsion for photography containing a chloride rich silver halide comprising 80 mole % or more of silver chloride under the conditions of pAg and/or temperature during the sulfur sensitization which are constituted of at least two different steps with lapse of time.

According to this invention, there is provided a silver halide emulsion which can give a good image without any change, can exhibit advantages of silver chloride, and is improved in the drawbacks of high fog and poor shelf-stability of silver chloride.

22 Claims, 2 Drawing Figures

PROCESS FOR PREPARING SILVER HALIDE EMULSION

Figure 1:
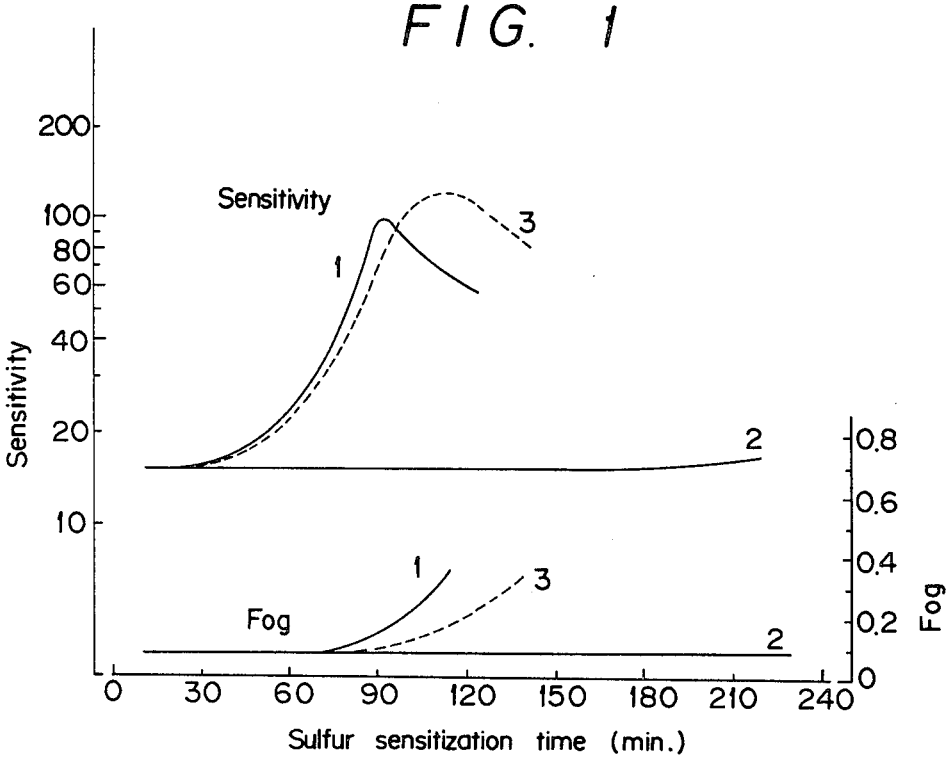

This invention relates to an improved chloride rich silver halide emulsion. More specifically, it relates to chemical sensitization of a chloride rich silver halide emulsion for photography.

Commercially available silver halide photographic elements may be classified into a large number of kinds depending on their uses, but silver bromide or silver iodobromide, silver chlorobromide composed principally of silver bromide have been primarily used on account of high sensitivity for such elements.

On the other hand, chloride rich silver halide emulsions have been known to be capable of being processed more quickly as compared with emulsions composed principally of silver bromide. Among several reasons therefor which may be considered, one reason is that silver chloride is more soluble than silver bromide. Also, since silver chloride absorbs substantially no visible light, it is not necessary to take a large difference between the blue sensitivities of a green-sensitive emulsion and of a red-sensitive emulsion and the blue sensitivity of a blue-sensitive emulsion, respectively, when it is to be used for a light-sensitive color photographic material. This means that a yellow filter may be removed in some kinds of light-sensitive color photographic materials and also that elimination of colloidal silver, which have caused troubles such as formation of fog in adjacent emulsion layers, may be possible. Besides, in some kinds of light-sensitive color photographic materials, emulsions with larger grain sizes, which have been employed in order to maintain the blue sensitivity of a blue-sensitive emulsion at an overwhelmingly higher level than the blue sensitivities of other emulsions, may be replaced with emulsions with smaller grain sizes, whereby the drawbacks such as tendency toward fog-lowering in developing rate, etc. caused by larger grain sizes are known to be alleviated.

However, chloride rich silver halide emulsions are also known to easily fog and be inferior in storage stability. Further, they are also known to be low in sensitivity due to absence of light absorption at the visible light region. In addition, according to the study by the present inventors, when a chloride rich silver halide emulsion is chemically sensitized with the use of a sulfur sensitizer such as sodium thiosulfate, the general procedure is such that only the low density region in the characteristic curve is sensitized at the initial stage, and thereafter the medium density region and the higher density region are sensitized and the gradation is recovered. And, in this case, the period when the gradation is recovered, the period when fog starts to increase and the period when the sensitivity reaches the maximum are very near to each other, whereby the period at which practically feasible performance can be exhibited is disadvantageously limited to a very narrow time range. This tendency is further pronounced for the emulsion with larger grain sizes, and increase of fog begins before recovery of the gradation, thus proving that the use of the emulsion is made practically impossible. Also, in sulfur sensitization of chloride rich silver halide emulsions, the induction period is relatively longer with subsequent abrupt changes, whereby only the results poor in reproducibility have been obtained as the performance of sulfur sensitized emulsions.

In recent years, there is an increasing tendency to process a large amount of light-sensitive color photographic materials for print at high speed, and it is strongly demanded that the performance of the light-sensitive materials should be constant either within the same production lot or between the production lots. As previously mentioned, chloride rich silver halide emulsions, while they are most promising materials in the future for their possibility for quick process, suffer from the great drawback with respect to reproducibility of sulfur sensitization. This drawback can be reduced to a great extent by the sulfur sensitization method according to this invention. These are all problems which are inherent or particularly marked in chloride rich silver halide emulsions and the method of this invention cannot easily be estimated from the knowledges obtained from the emulsions primarily constituted of silver bromide such as silver iodobromide, silver chlorobromide, etc.

As a method for reducing the drawback accompanied with the use of sulfur sensitization, it may also be effective to select a sensitizer. However, the characteristics required for a sensitizer are very severe. For example, high storage stability is required when storing a sensitizer in the form of a crystal or a solution. Secondly, the rate of the sensitizing reaction should be appropriate. Thirdly, on termination of sensitization, residual sensitizer should be present in minute amounts. There exist only a limited number of compounds which can satisfy all of these conditions even to a practical extent without completely satisfying thereof.

As sulfur sensitizers, there have been employed for a long time thiosulfates such as sodium thiosulfate, substituted thiourea compounds as disclosed in Japanese provisional patent publication Nos. 29829/1980 and 45016/1980. These cannot be said yet to satisfy completely the above conditions.

Nevertheless, the effect of the sulfur sensitization method of this invention is not incompatible with the effect of improvement of these sensitizers. Better performance of a chloride rich silver halide can be extracted by both with improvements of these sensitization method and sensitizers.

An object of this invention is to provide a silver halide photographic emulsion and a process for producing thereof suitable for quick development of which fog is reduced.

Another object of this invention is to provide a silver halide photographic emulsion and process for producing thereof suitable for quick process which has a good gradation.

Still another object of this invention is to provide a silver halide photographic emulsion suitable for quick process which is excellent in storage stability.

More specifically, still another object of this invention is to provide a method for producing a silver halide photographic emulsion sulfur sensitized with a small amount of a sulfur sensitizer with good reproducibility.

As the result of the extensive studies made by the present inventors, it has now been found that the above objects can be accomplished by a process for producing a silver halide emulsion, comprising sulfur sensitizing a silver halide emulsion for photography containing a chloride rich silver halide comprising 80 mole % or more of silver chloride under the conditions of pAg and/or the temperature during the sulfur sensitization which are constituted of at least two different steps with lapse of time.

In the following, unless otherwise noted, the silver halide emulsion prepared according to the above method of this invention is referred to as the silver halide emulsion according to this invention.

In the accompanying drawings,

FIG. 1 is a graph indicating the difference in the manner of progress between the sulfur sensitization according to the method of prior art and the sulfur sensitization according to this invention, having two steps that differ in temperature.

Figure 2:
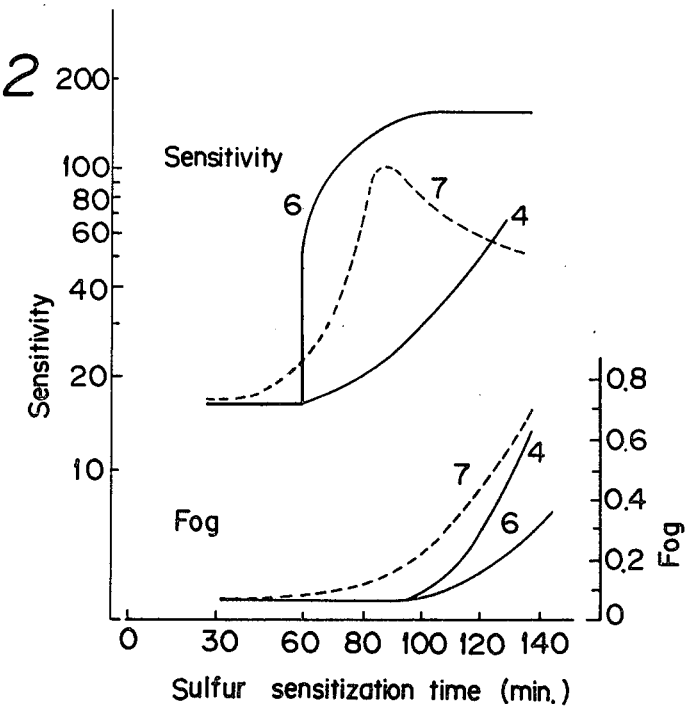

FIG. 2 is a graph comparing the manner of progress of sulfur sensitization in the emulsion sensitized by the method according to this invention having two steps that differ in temperature and pAg with that sulfur sensitized according to the method of the prior art using a relatively large amount of a sensitizer and that sulfur sensitized according to the method of the prior art using a small amount of a sensitizer.

The sulfur sensitization method according to this invention comprises in operation two or more steps, in which transition from the first step to the second step during sensitization is effected by change of temperature or pAg. This means controlling of the conditions so as to give the reaction rates corresponding to the steps during sensitization, whereby keeping the steady performance of the silver halide emulsion obtained as the result of sulfur sensitization. Accordingly, it is also possible to effect transition to the third step, the fourth step et seq which may be defined in operation after the second step by changing temperature and/or pAg.

As previously mentioned, the performance of the silver halide emulsion is kept steady by use of such a sulfur sensitizing method. In other words, since sulfur sensitization is possible under the conditions for which more severe control is required, improvement of performance is rendered possible by selection of the conditions. The present inventors have availed themselves of this theory and were successful in reducing fog and making smaller the change in performance of the coated samples with storage under high temperature conditions by reducing the amount of a sensitizer, while maintaining the time for sulfur sensitization similar to that of the prior art. The amount of a sensitizer may be preferably at a level of $3\times10^{-3}$ or less molecules of a sensitizer per one silver ion existing on the surface of silver halide crystals, more preferably $5\times10^{-5}$ to $1\times10^{-3}$.

In this invention, the conditions of pAg and/or temperature are changed at least once during sulfur sensitization. With regard to temperature, the temperature in the second step should preferably be within 30° C. to 80° C. and lower by 3° C. to 30° C. than that in the first step. As for pAg, it should preferably be within the range from 5.7 to 8.4 in the second step and higher by 0.1 or more, more preferably within the range from 0.1 to 1.5, than that in the first step.

The first step in sulfur sensitization may be preferably conducted under the conditions of a temperature of 50° C. to 80° C., pH=2.0 to 6.0, and pAg=5.7 to 7.6. Transition from the first step to the second step may be at any point during the first step, but preferably at a period when the sensitivity of the silver halide emulsion is ½ or lower of the maximum sensitivity (the sensitivity on completion of sulfur sensitization), more preferably at a period when the sensitivity of the silver halide emulsion is not higher by 25% or more than the sensitivity before sulfur sensitization. If the transition of sulfur sensitization system to the second step is delayed, fog is increased to give no desirable result. On the contrary, if it is too early, progress of sensitization is markedly retarded to take a long time for sulfur sensitization.

Transition to the second step in sulfur sensitization may preferably be conducted by changing the conditions of sulfur sensitization to those of (1) or (2) shown below or a combination thereof.

(1) To lower the temperature to the range from 30° C. to 80° C.

It is preferred to take a sufficiently large temperature difference between the first step and the second step. But, if it is too large, sulfur sensitization progresses very slowly so that a long time is unfavorably required for sulfur sensitization. A preferable temperature difference is 3° C. to 30° C., more preferably 5° C. to 20° C. In any case, the temperature in the second step should not be lower than 30° C.

(2) To elevate pAg to the range from 5.7 to 8.4.

An aqueous halide salt solution is added to elevate pAg, and any kind of a halide salt may be used therefor. However, it is not essentially required to effect conversion of halide ions on the surface of silver halide grains, and a chloride such as sodium chloride or potassium chloride may preferably be used. By elevation of pAg through adding such a halide salt, a remarkable progress of sulfur sensitization may be observed within a very short period of time immediately after the addition.

The preferable width of pAg change and pAg value in the second step of sensitization should be varied depending on such factors as the conditions for preparation of the silver halide emulsion, grain sizes, crystal habits, etc. or the pAg value in the first step of sulfur sensitization, and they should finally be determined experimentally for respective emulsions. To show the numerical values as a measure, the width of pAg change may be 0.1 or more, preferably within the range from 0.1 to 1.5, more preferably within the range from 0.1 to 1.0, but at the same time it is necessary to take care so that the pAg in the second step may have a preferable value. The preferable value of pAg in the second step is within the range from 5.7 to 8.4, more preferably from 7.0 to 8.0. At an extremely high value of pAg, fog tends to be markedly increased to a disadvantage.

The emulsion according to this invention may preferably be a negative working emulsion, namely an emulsion of the so-called surface latent image type, in which a latent image is formed primarily on the grain surfaces thereof. The term of surface latent image type emulsion is the terminology representing the concept opposed to the term of internal latent image type emulsion as defined in, for example, Japanese provisional patent publication No. 32814/1972. In a negative working emulsion, the image to be provided for practical use is formed by elevation of the image density as the increase of exposure. Of course, in such an emulsion, a phenomenon of so-called solarization may occur in which inversion is caused by excessive dosage of exposure, but this is no problem because it is a phenomenon caused by a dosage of exposure exceeding the normal exposure for practical use.

The silver halide to be used in this invention is a chloride rich silver halide comprising 80 mole % or more of silver chloride, which may also contain 20 mole % or less of silver bromide. It is not preferred to contain silver iodide, but only in an amount of at most 1 mole % or less even if it may be contained. When silver bromide is contained, it may either form a localized layer within the grains or on the surface of grains, but the effect of this invention is greater when no silver bromide is present at least on the surface of grains. The content of silver chloride is preferably 90% or more, more preferably it is a pure silver chloride.

The silver halide to be used in this invention may be used preferably, whether it may have a plane (100) or a plane (111) or both thereof on its outer surface. A silver halide having a (110) plane on its outer surface may also preferably be used.

The grain sizes of the silver halide to be used in this invention may be within the range usable as ordinary light-sensitive photographic material, but preferably within the range of average grain size from 0.05 μm to 2.0 μm. The grain size distribution may be either polydispersed or mono-dispersed, the latter being preferred.

The silver halide grains to be used in this invention may be prepared according to the methods conventionally practiced by those skilled in the art. These methods are described in textbooks such as, for example, "The Theory of Photographic Process" by Mees (published by Macmillan Publishing Co.), and preparation may be possible according to various generally known methods such as the ammoniacal emulsion making method, neutral or acid emulsion making method, etc.

Addition of a halide salt and a silver salt may be performed any of the single jet method and the double jet method written in Chapter 3 of "Fundamentals of Photographic Engineering—Silver Salt Photography" by Akira Hirata, edited by Japanese Society of Photography (published by Corona Co., Ltd.), but preferably according to the double jet method, wherein both are simultaneously injected into a reactor and silver halide crystals are precipitated in the presence of a suitable protective colloid. Among the double jet methods, the so-called balanced double jet method may particularly preferably employed in which mixing is conducted while controlling the rates of addition of a halide salt solution and a silver salt solution so that pAg may be maintained within a certain range. It is also thereby preferred to control not only pAg but also pH and temperature to suitable values during precipitation.

For example, pH value may preferably be 2.0 to 8.5, particularly 3.0 to 7.5, while pAg value may be preferably 6.0 to 9.0, particularly 7.0 to 8.0. The temperature may be preferably 40° C. to 85° C., particularly 45° C. to 75° C.

Various devices for preparation of such silver halide grains have been proposed. For example, there is the method as disclosed in Japanese patent publication No. 21045/1973, in which strong agitation is performed in a relatively small precipitation chamber to carry out a rapid precipitation reaction, followed by subsequent physical ripening in a relatively large volume ripening chamber, and the dispersion is recirculated into the precipitation chamber as a medium for precipitation of silver halide; or the method as disclosed in Japanese patent publication No. 48964/1974, in which a precipitation chamber is sunk in a reactor, a silver salt solution and a halide salt solution are injected into the liquid at different portions in the precipitation chamber to be diluted with the liquid in the reactor, then mixed to carry out a rapid precipitation reaction, thereafter physical ripening is conducted by discharging the diluted product into the reactor outside of the precipitation chamber, and the dispersion is introduced again as a medium for precipitation of silver halide. These devices may be used particularly preferably for preparation of the silver halide emulsion according to this invention.

The silver halide emulsion may be either subjected to physical ripening or not. The water soluble salts are removed from the emulsion after formation of precipitation or after physical ripening. As the method for this purpose, there may be employed either the noodel washing method which has been known for a long time or the flocculation method utilizing inorganic salts having polyvalent anions (e.g. ammonium sulfate, magnesium sulfate), anionic surfactants, polystyrene sulfonic acid or other anionic polymers, or gelatin derivatives such as aliphatic or aromatic-acylated gelatin.

In the emulsion to be used in this invention, gelatin is primarily used as protective colloid. Particularly, an inert gelatin is useful. In place of gelatin, there may also be employed photographically inert gelatin derivatives (e.g. phthalated gelatin, etc.), water soluble synthetic polymers (e.g. polyvinyl alcohol, polyvinyl pyrrolidone, carboxymethyl cellulose, hydroxymethyl cellulose, etc.) and the like.

As the sensitizer to be used in the sulfur sensitization according to this invention, there may be included thiosulfates or compounds as disclosed in U.S. Pat. Nos. 1,574,944, 2,278,947, 2,410,689, 3,189,458 and 3,501,313, French Pat. No. 2,059,245, and Japanese provisional patent publication No. 45016/1980. An active gelatin may also be available.

The sulfur sensitization according to this invention may also be used in combination with another sensitization method, including, for example, the reduction sensitization method employing the stannous salts disclosed in U.S. Pat. No. 2,487,850; amines disclosed in U.S. Pat. Nos. 2,518,698, 2,521,925, 2,521,926, 2,419,973, 2,419,975, etc.; iminoaminomethane sulfinic acid disclosed in U.S. Pat. No. 2,983,610; silane compounds disclosed in U.S. Pat. No. 2,694,637; or according to the method of H. W. Wood disclosed in Journal of Photographic Science, Vol. 1 (1953), page 163 et seq; the gold sensitizing method employing gold complex salts or gold thiosulfate complex salts disclosed in U.S. Pat. No. 2,399,083; or the sensitization method employing salts of noble metals such as platinum, palladium, iridium, rhodium, ruthenium disclosed in U.S. Pat. Nos. 2,448,060, 2,540,086, 2,566,245 and 2,566,263; and the selenium sensitizing method disclosed in U.S. Pat. No. 3,297,446.

The silver halide emulsion according to this invention may be spectrally sensitized with sensitizing dyes having sensitizing abilities at various wavelength regions depending on the purposes. As these sensitizing dyes, there may be employed cyanine dyes, merocyanine dyes, hemicyanine dyes as described in textbooks such as the aforesaid "The Theory of Photographic Process", 3rd Edition, edited by Mees & James, published by Macmillan Publishing Co.; and "The Theory of Photographic Process" 4th Edition, edited by James, published by Macmillan Publishing Co., and generally admitted in the art, either singly or as a combination of two or more kinds.

The optimum concentration of the sensitizing dye employed may be determined according to the method known to those skilled in the art by dividing the same emulsion into several portions, incorporating the sensitizing dye at different concentration in respective portions and measuring the respective sensitivities. The concentration of the sensitizing dye is not particularly limited, but it is advantageous to employ a sensitizing dye in a concentration of about $2\times10^{-6}$ to about $1\times10^{-3}$ mole per mole of silver halide.

These sensitizing dyes may be added into an emulsion at any time during preparation of the emulsion, but preferably during or after sulfur sensitization. In carrying out the addition, there may be employed the methods well known in this kind of field. There is generally employed the method in which a dye is dissolved in a water soluble solvent such as pyridine, methyl alcohol, ethyl alcohol, methyl cellosolve, acetone (or a mixture of such solvents), sometimes diluted with water or sometimes dissolved in water, and then added in the form of these solutions into an emulsion.

Alternatively, it is also possible to employ the method as disclosed in U.S. Pat. No. 3,469,987 in which a dye is dissolved in a volatile organic solvent, said solution is dispersed in a hydrophilic colloid and the resultant dispersion is added into an emulsion, or the method as disclosed in Japanese patent publication No. 24185/1971, in which a water insoluble dye is dispersed without dissolving in a water soluble solvent and the resultant dispersion is added into an emulsion. There may also be employed other methods for adding dyes into emulsions as disclosed in U.S. Pat. Nos. 2,912,345, 3,342,605, 2,996,287 and 3,425,835.

It is also possible to incorporate tetrazaindenes, mercaptotetrazoles or other compounds in the photographic emulsion according to this invention, for the purpose of stabilizing the photographic performance in the preparation steps and during storage, and preventing fog at the time of developing process.

The light-sensitive photographic material of this invention may be either coupler in emulsion type light-sensitive photographic material or coupler in developer type light-sensitive photographic material.

The silver halide emulsion according to this invention may preferably contain an dye image forming substance. Examples of dye image forming substance may include dye developers, dye releasing redox compounds to be used for color diffusion transfer technique, and couplers to be used for conventional light-sensitive silver halide photographic materials.

The dye image forming substances to be used for color diffusion transfer technique may be exemplified by those as disclosed in U.S. Pat. Nos. 2,983,605; 2,983,606, 2,992,106, 3,047,386, 3,076,808, 3,076,820, 3,077,402, 3,126,280, 3,131,061, 3,134,762, 3,134,765, 3,135,604, 3,135,605, 3,135,606, 3,135,734, 3,141,772 and 3,142,565.

Other dye image forming substances to be used for color diffusion transfer technique may also include those as disclosed in U.S. Pat. Nos. 3,245,789, 3,443,939, 3,443,940, 3,443,943, 3,698,897, 3,725,062, 3,728,113, 3,751,406, 3,844,785, 3,928,312, 3,929,760, 3,931,144, 3,932,380, 3,932,381, 3,942,987 and 3,993,638, French Pat. No. 2,284,140, U.S. Pat. No. 351,673, Research Disclosure Nos. 13024 (1975), 15157 (1976), Japanese provisional patent publication Nos. 118723/1975, 104343/1976, 109928/1976, 113624/1976, 114930/1976, 7727/1977, 8827/1977, 3819/1978, 50736/1978, 4544/1978, 3820/1978, 50734/1978, 66227/1978 and 66730/1978.

Still other examples of dye image forming substances to be used for color diffusion transfer technique are disclosed in U.S. Pat. Nos. 3,227,550, 3,443,940 and 3,227,551, and U.K. Pat. No. 904,365.

As the coupler to be incorporated in the light-sensitive photographic material according to this invention, there may be employed any compound which can undergo coupling reaction with an oxidized color developing agent to form a coupled product having the maximum spectral absorption wavelength at a longer wavelength region than 340 nm, of which typical examples are set forth below.

As the coupler forming a coupling product having the maximum spectral absorption wavelength in the wavelength region from 350 nm to 500 nm, typical examples are those known to those skilled in the art as so-called yellow coupler, as disclosed in U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140, 3,894,875, U.K. Pat. Nos. 778,089, 808,276, 875,476, 1,402,511, 1,421,126 and 1,513,832 and Japanese patent publication No. 13576/1974, Japanese provisional patent publication No. 29432/1973, 66834/1973, 10736/1974, 122335/1974, 28834/1975, 132926/1975, 138832/1975, 3631/1976, 17438/1976, 26038/1976, 26039/1976, 50734/1976, 53825/1976, 75521/1976, 89728/1976, 102636/1976, 107137/1976, 117031/1976, 122439/1976, 143319/1976, 9529/1978, 82332/1978, 135625/1978, 145619/1978, 23528/1979, 48541/1979, 65035/1979, 133329/1979 and 598/1980.

As the coupler forming a coupling product having the maximum spectral absorption wavelength in the wavelength region from 500 nm to 600 nm, typical examples are those known to those skilled in the art as so-called magenta coupler, as disclosed in U.S. Pat. Nos. 1,969,479, 2,213,986, 2,294,909, 2,338,677, 2,340,763, 2,343,703, 2,359,332, 2,411,951, 2,435,550, 2,592,303, 2,600,788, 2,618,641, 2,619,419, 2,673,801, 2,691,659, 2,803,554, 2,829,975, 2,866,706, 2,881,167, 2,895,826, 3,062,653, 3,127,269, 3,214,437, 3,253,924, 3,311,476, 3,419,391, 3,486,894, 3,519,429, 3,558,318, 3,617,291, 3,684,514, 3,705,896, 3,725,067 and 3,888,680, U.K. Pat. Nos. 720284, 737700, 813866, 892886, 918128, 1019117, 1042832, 1047612, 1398828 and 1398979, German Pat. Nos. 814,996 and 1,070,030, Belgian Pat. No. 724,427, Japanese provisional patent publication Nos. 60479/1971, 29639/1974, 111631/1974, 129538/1974, 13041/1975, 116471/1975, 159336/1975, 3232/1976, 3233/1976, 10935/1976, 16924/1976, 20826/1976, 26541/1976, 30228/1976, 36938/1976, 37230/1976, 37646/1976, 39039/1976, 44927/1976, 104344/1976, 105820/1976, 108842/1976, 112341/1976, 112342/1976, 112343/1976, 112344/1976, 117032/1976, 126831/1976, 31738/1977, 9122/1978, 55122/1978, 75930/1978, 86214/1978, 125835/1978, 123129/1978 and 56429/1979.

As the coupler forming a coupling product having the maximum spectral absorption wavelength in the wavelength region from 600 nm to 750 nm, typical examples are those known to those skilled in the art as so-called cyan coupler, as disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308 and 3,839,044, U.K. Pat. Nos. 478991, 945542, 1084480, 1377233, 1388024 and 1543040, and Japanese provisional patent publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979 and 32071/1980.

As the coupler forming a coupling product having the maximum spectral absorption wavelength in the wavelength region from 700 nm to 850 nm, typical examples are disclosed in Japanese patent publication No. 24849/1977, Japanese provisional patent publication Nos. 125836/1978, 129036/1978, 21094/1980, 21095/1980, 21096/1980, etc.

The silver halide emulsion according to this invention is generally employed together with the aforesaid dye image forming substance, both being contained in the same layer or each of them being contained in the adjacent layers, respectively, and preferably both being contained in the same layer. For example, when a coupler is to be incorporated within a light-sensitive material, it can be included by dispersing in a hydrophilic colloid according to a technically effective method. As these dispersing methods, there may be used various methods well known in the art, preferably the method in which these couplers are dissolved in substantially water insoluble high boiling point solvents and dispersed in a hydrophilic colloid.

As particularly useful high boiling point solvents, there may be mentioned, for example, N-n-butylacetanilide, diethyllauramide, dibutyllauramide, dibutylphthalate, dioctylphthalate, tricresyl phosphate, N-dodecylpyrrolidone, etc. For aiding in the above dissolution, there may be employed low boiling point solvents or organic solvents readily soluble in water. As low boiling point solvents and organic solvents readily soluble in water, there may be employed, for example, ethyl acetate, methyl acetate, cyclohexanone, acetone, methanol, ethanol, tetrahydrofuran, 2-methoxyethanol, dimethylformamide, etc. These low boiling point solvents and organic solvents readily soluble in water can be removed by washing with water or drying after coated.

Further, the silver halide emulsion according to this invention may also contain various other additives for photography, including, for example, well known hardeners, surfactants, UV absorbers, fluorescent whiteners, physical property modifiers (humectants, water dispersants of polymer), condensates of phenols and formalin, etc.

And, the silver halide photographic emulsion according to this invention is generally coated on a suitable support and dried to prepare a light-sensitive silver halide photographic material. As the support to be employed, there are supports such as of paper, glass, cellulose acetate, cellulose nitrate, polyester, polyamide, polystyrene and the like, or laminated products of two or more substrates such as laminated products of paper and polyolefin (e.g. polyethylene, polypropylene, etc.). And, the support may be subjected generally to various surface modification treatments for improvement of adhesion to the silver halide emulsion, such as the surface treatment of, for example, electron impact treatment, etc. or subbing treatment to provide a subbing layer.

Coating and drying of the silver halide photographic emulsion on the support may be conducted according to conventional procedures by carrying out coating by, for example, dip coating, roller coating, multi-slide hopper coating, curtain flow coating, etc., followed by drying.

The light-sensitive silver halide photographic material is basically constituted as described above. Further, by combining suitably various photographic constituent layers selected, if desired, from blue sensitive, green sensitive and red sensitive silver halide photographic emulsion layers, intermediate layers, protective layers, filter layers, antihalation layers, backing layers and others, a light-sensitive color photographic material can be formed. In this case, each light-sensitive emulsion layer may be constituted of two emulsion layers with different sensitivities.

The light-sensitive silver halide color photographic material may be applied effectively for various uses such as color negative film, color reversal film, color photographic paper, instant photography, etc., but particularly useful for color photographic paper.

The light-sensitive photographic material having the silver halide emulsion according to this invention can be processed according to conventional procedures after exposure. The processing temperature and time may conveniently be set, and the temperature may be at room temperature or lower than room temperature, for example, 18° C. or lower, or higher than room temperature, higher over 30° C., for example, at around 40° C., or further a temperature over 50° C.

For color development, as the color forming developing agent, there may be employed, for example, N,N-dimethyl-p-phenylenediamine, N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofurfuryl-2-methyl-p-aminophenol, 3-acetylamino-4-aminodimethylaniline, N-ethyl-N-$\beta$-methanesulfonamidoethyl-4-aminoaniline, N-ethyl-N-$\beta$-methanesulfonamidoethyl-3-methyl-4-aminoaniline, sodium salt of N-methyl-N-$\beta$-sulfoethyl-p-phenylenediamine, etc.

The light-sensitive photographic material of this invention may contain these color developing agents as such, or alternatively as precursors thereof which may be processed with an alkaline activating bath. The color developing agent precursors are compounds capable of forming color developing agents under alkaline conditions, including Schiff base type precursors with aromatic aldehyde derivatives, polyvalent metal ion complex precursors, phthalimide derivative precursors, phosphoramid derivative precursors, sugar-amine reaction product precursors, urethane type precursors, and the like. These precursors of aromatic primary amine color developing agents are disclosed in, for example, U.S. Pat. Nos. 3,342,599, 2,507,114, 2,695,234 and 3,719,492, U.K. Pat. No. 803783, Japanese provisional patent publication Nos. 135628/1978 and 79035/1979, Research Disclosure Nos. 15159, 12146 and 13924.

These aromatic primary amine color developing agents or precursors thereof should be added in amounts so as to obtain sufficient color formation with said amounts alone, when processed with activating bath. Such amounts, which may differ considerably depending the kind of the light-sensitive photographic material, may be approximately within the range from 0.1 mole to 5 moles preferably 0.5 mole to 3 moles, per mole of the light-sensitive silver halide, to obtain advantageous results. These color developing agents or precursors thereof may be used either individually or in combination. For inclusion in the light-sensitive photographic material, they may be added as solutions in an appropriate solvent such as water, methanol, ethanol, acetone, etc. or as emulsions with the use of a high boiling point solvent such as dibutylphthalate, dioctylphthalate, tricresyl phosphate, etc. Alternatively, it is also possible to incorporate them by impregnation in a latex polymer, as disclosed in Research Disclosure No. 14850.

Usually, after color development, bleaching process and fixing process are carried out. Bleaching process may be performed simultaneously with fixing process. As the bleaching agent, there may be employed a large number of compounds, preferably polyvalent metal compounds such as iron (III), cobalt (III), copper (II), particularly complex salts of these polyvalent metal cations with organic acids, including metal complexes of aminopolycarboxylic acids such as ethylenediaminetetraacetic acid, nitrilotriacetic acid, N-hydroxyethylethylenediaminediacetic acid; metal complex salts of malonic acid, tartaric acid, malic acid, diglycolic acid, dithioglycolic acid and the like; or ferricyanate, dichromates, either individually or in a suitable combination.

EXAMPLE 1

One liter of a 1 mole/l silver nitrate solution and a 1 mole/l sodium chloride solution were added by means of metering pumps into 700 ml of a 4% aqueous gelatin solution containing 6 g of sodium chloride taking 50 minutes. During this operation, pAg was controlled to be maintained at 7.9.

Subsequently, washing with water and desalination were performed according to the following procedures.

As precipitating agents, a 5% aqueous Demol N (produced by Kao Atlas Co.) and a 20% aqueous magnesium sulfate solution were added at a ratio of 10:9 until precipitates were formed. After precipitates were sedimented by standing, the supernatant was removed by decantation and 3 liters of distilled water were added to disperse again the precipitates therein. A 20% aqueous magnesium sulfate solution was added until the precipitates were formed again, and after standing, the supernatant was subjected to decantation. Then, an aqueous gelatin solution was added and stirred at 40° C. for 20 minutes to effect re-dispersion, followed by addition of an aqueous sodium chloride solution to adjust pAg=7.6 simultaneously with addition of distilled water to make up the volume. The resultant emulsion had a gelatin concentration of 5% and a volume of 560 ml. This emulsion is called as Em-1 hereinbelow. As the result of observation by electromicroscopy, this emulsion was found to have an average crystal size of 0.4 μm.

Em-1 was sampled into 3 aliquots each of 100 ml, one of which was subjected to sulfur sensitization by addition of $2.6\times10^{-6}$ mole ($1.5\times10^{-5}$ mole/mole AgX) of sodium thiosulfate. During the sulfur sensitization, the temperature was maintained at 60° C. The second sample was sulfur sensitized by addition of the same quantity of sodium thiosulfate at 50° C. The third sample was sulfur sensitized with the same quantity of sodium thiosulfate at 60° C., and the temperature was lowered to 50° C. after 50 minutes.

Into the three kinds of emulsions, there were added $3.0\times10^{-4}$ mole of a sensitizing dye (GS-1*) per mole of silver halide 5 minutes before termination of sulfur sensitization, and 1 g of a stabilizer (ST-1**) per mole of silver halide on termination of sulfur sensitization. Subsequently, 0.25 mole of a magenta coupler (MC-1*3) per mole of silver halide, 0.15 mole of a color stain preventing agent (AS-1*4) per mole of said coupler which were dissolved in tricresyl phosphate (abbreviated hereinafter as TCP) and were dispersed in hydrophilic colloid, were added to the emulsion.

* GS-1: anhydro-5,5'-diphenyl-9-ethyl-3,3'-di-(γ-sulfopropyl)oxacarbocyanine hydroxide

** ST-1: 4-hydroxy-6-methyl-1,3,3a,7-tetrazaindene

*3 MC-1: 3-[2-chloro-5-(1-octadecenylsuccinimido)-anilino]-1-(2,4,6-trichlorophenyl)-5-pyrazolone

*4 AS-1: 2,5-di-t-octylhydroquinone

On a paper support for photography laminated with a polyethylene containing an anatase type titanium oxide, each of the above emulsions was coated to a coated silver quantity of 0.40 g/m² as metallic silver and 3.0 g/m² of gelatin, and a gelatin was further coated thereon to 2 g/m² to provide a protective layer. The protective layer contained bis(vinylsulfonylmethyl)ether as a hardener and saponin as an surfactant.

Each sample as prepared above was subjected to wedgewise exposure to the yellow light (Wratten No. 12 Filter, produced by Eastman Kodak Co.) by means of a photo-sensitometer KS-7 (produced by Konishiroku Photo Industry Co.), and thereafter the following color development (CD-1) was carried out.

The reflective density of the dye image formed in each sample was measured by means of the Sakura Color Densitometer PDA-60 Model (produced by Konishiroku Photo Industry Co.) with the use of an auxiliary green filter.

| Processing steps | |
|---|---|
| Color development (CD-1) | 33° C. one minute |
| Bleach-fix | 33° C. one minute 30 seconds |
| Washing | 30–34° C. 3 minutes |
| Drying | |

| Composition of color developer (CD-1) | |
|---|---|
| Distilled water | 800 ml |
| Ethylene glycol | 12 ml |
| Benzyl alcohol | 12 ml |
| Anhydrous potassium carbonate | 30 g |
| Anhydrous potassium sulfite | 2.0 g |
| N—ethyl-N—(β-methanesulfonamido)-ethyl-3-methyl-4-aminoaniline sulfate | 4.5 g |
| Adenine | 0.03 g |
| Sodium chloride | 1.0 g |
| (adjust to pH = 10.2 with potassium hydroxide or sulfuric acid and make up to one liter) | |

| Composition of bleach-fix solution | |
|---|---|
| Distilled water | 750 ml |
| Sodium ethylenediaminetetraacetato ferrate (III) | 50 g |
| Ammonium thiosulfate | 85 g |
| Sodium bisulfite | 10 g |
| Sodium metabisulfite | 2 g |
| Disodium ethylenediamine-tetraacetate | 20 g |
| Sodium bromide | 3.0 g |
| (make up to one liter with distilled water, and adjust to pH = 7.0 with ammonia water or sulfuric acid) | |

The results are shown in FIG. 1.

In FIG. 1, the curve 1 indicates Control example sensitized at 60° C., the curve 2 Control example sensitized at 50° C. and the curve 3 Example of the invention sensitized at 60° C. for 50 minutes in the first step and at 50° C. in the second step.

In Control example 2, although sensitization had been conducted over a long time of 200 minutes, the sensitivity was the same as that of the sample which was not subjected to sulfur sensitization. As apparently seen from this result, no substantial sulfur sensitization proceeded at a temperature of 50° C. In Control example 1, the induction period was long, whereafter there was an abrupt change of sensitivity. And, the time for sensitization to exhibit the maximum sensitivity was limited to a very narrow region, whereby the reproducibility of the performance of the sulfur sensitized emulsion was disadvantageously poor. In the silver halide emulsion according to this invention, although the temperature was lowered to 50° C. before no substantial change of sensitivity had occurred, there was little delay of sulfur sensitization and the time range exhibiting the maximum sensitivity was noticeably enlarged.

Thus, it would be understood that the silver halide emulsion prepared by the method according to this invention is small in fluctuations of the emulsion performance and enhanced remarkably in reproducibility.

EXAMPLE 2

The performance of a silver halide emulsion prepared by the method according to this invention in the case the quantity of a sulfur sensitizer decreased is as follows.

Em-1 was prepared similarly as in Example 1, and after re-dispersion adjusted to pAg of 6.6. A sample of 300 ml of this emulsion was sulfur sensitized by addition of $1.5\times10^{-6}$ mole ($2.8\times10^{6}$ mole/mole AgX) of sodium thiosulfate at 70° C., and in the course of this sensitization divided into aliquots, each of which was continued to be sensitized under various conditions of sensitization (see details of the conditions in Table 1 below). Separately, another 100 ml sample of the emulsion was adjusted to pAg of 7.6 and sulfur sensitization was effected by adding $2.6\times10^{6}$ mole ($1.5\times10^{-5}$ mole/mole AgX) of sodium thiosulfate at 60° C. Then, coated samples were prepared according to the method of Example 1.

Two sheets were prepared for respective samples, one sample being stored in a refrigerator and the other under a higher temperature condition of 55° C. for about 2 days. These were subjected at the same time to exposure and the processing under the conditions shown in Example 1.

The results are shown in Table 1, wherein sensitivities for those stored in a refrigerator are given in terms of relative values to Control example 7 as 100, and the sensitivities for those stored at higher temperature in terms of relative values to respective samples stored in the refrigerator as 100.

FIG. 2 shows the changes with the sensitization time of the Sample 6 employing the sulfur sensitization method according to this invention as compared with Control examples 4 and 7 according to conventional sulfur sensitization methods. When a relatively large quantity of a sensitizer is used as shown in Control example 7, in which the maximum sensitivity is realized only within a very narrow time range to give results with poor reproducibility as also described in Example 1. In contrast, when the sensitizer is reduced to an amount of about 1/5, the progress of sulfur sensitization becomes markedly slow. For this reason, in Control example 4, wherein pAg is lowered and the temperature is elevated, the progress of sulfur sensitization can be seen, but fog is markedly increased to give no satisfactory result. That is, under the conditions such that a sensitizer is reduced to an amount of about 1/5, no satisfactory performance can be obtained with a sensitizing time similar to that of the prior art. In Samples 5 and 6, for which the sulfur sensitization method according to this invention were applied, no much elongation of the sensitizing time was required and there could be obtained high sensitivity while suppressing increase in fog. Moreover, when these samples were stored at a higher temperature, increase in fog was markedly seen in Control sample 7 also with the change in sensitivity, while remarkable improved effects could be seen in Samples 5 and 6 according to this invention.

With regard to the manner of progress of sulfur sensitization, in the Sample 6 according to this invention, the change in performance was very slow after the abrupt elevation of the sensitivity immediately after addition of an aqueous sodium chloride solution, whereby reproducibility of the emulsion performance after sulfur sensitization was markedly enhanced.

Thus, it is surprising that the sulfur sensitization method according to this invention enables progress of sulfur sensitization even under the conditions of the greatly decreased amount of a sensitizer without spending any superfluous time, and can also improve markedly sensitivity and shelf-stability under high temperature conditions, and can decrease fog.

EXAMPLE 3

This Example illustrates the influence of the timing at which sulfur sensitization transits from the first step to the second step on the performance.

TABLE 1

| | Sensitizing conditions | | | | Stored in refrigerator | | Stored at high temperature | |
|---|---|---|---|---|---|---|---|---|
| | First step of sensitization | Second step of sensitization | Amount of sensitizers | Total of sensitizing time | Sensitivity | Fog | Sensitivity | Fog |
| 4. Control | 70° C. pAg = 6.6 | No change | $\times 10^{-4}$ mole/mole AgX 2.8 | 130 min. | 68 | 0.45 | — | 1.10 |
| 5. This invention | 70° C. 60 min. pAg = 6.6 | changed to 60° C. No pAg change | 2.8 | 110 min. | 140 | 0.08 | 108 | 0.09 |
| 6. This invention | 70° C. 60 min. pAg = 6.6 | changed to 60° C. changed to pAg = 7.5 | 2.8 | 100 min. | 152 | 0.07 | 106 | 0.08 |
| 7. Control | 60° C. pAg = 7.6 | No change | 1.5 | 90 min. | 100 | 0.13 | 150 | 0.25 |

Em-1 was prepared similarly as in Example 1 and after re-dispersion adjusted to a pAg of 6.6. To 300 ml of the resultant emulsion, there was added $1.5\times10^{-6}$ mole ($2.8\times10^{-6}$ mole/mole AgX) of sodium thiosulfate and sulfur sensitization was carried out at 70° C. The emulsion was divided at 30 minutes, 60 minutes and 90 minutes after initiation of sensitization, respectively, added with an aqueous sodium chloride solution, adjusted to a pAg of 7.5 and sensitization was continued while lowering at the same time the temperature to 60° C. Then, following the method of Example 1, samples were prepared. The results are shown in Table 2. Sensitivities are shown in terms of relative values to Sample 9 as 100.

TABLE 2

| Sample No. | First step of sensitization | Total of sensitization time | Sensitivity | Fog |
|---|---|---|---|---|
| 8 | 30 min. | 200 min. | 92 | 0.11 |
| 9 | 60 min. | 100 min. | 100 | 0.08 |
| 10 | 90 min. | 95 min. | 95 | 0.14 |

In Sample 8, due to too early transition to the second step, the timing corresponded to the period at which the gradation was greatly disturbed as the specific feature of the sulfur sensitization of a chloride rich silver halide emulsion as described above. At this period of time, the characteristic curve exhibits a shape of so-called two-stage curve and it will take a long time of 200 minutes until this is completely vanished to recover the gradation to result in the increase of fog. In contrast, in Sample 10, transition to the second step is too late, and fog was high enough at the time when an aqueous sodium chloride solution was added. In such a case, the sensitizing time is determined by the time of sulfur sensitization in the first step and therefore the effect of improving reproducibility the emulsion performance is smaller as compared with the case of Sample 9 where appropriate conditions are employed.

As described above, even if the timing of transition from the first step to the second step may be somewhat deviated from the optimum one, the improved effect can be sufficiently recognized although its extent may be more or less reduced. Although the data are not shown here, these three kinds of samples were also excellent in shelf-stability under high temperature conditions similarly as in the case of Example 2. However, it would be appreciated that the timing of transition from the first step to the second is an important point in order to obtain sufficiently the improved effect of the invention.

EXAMPLE 4

This Example illustrates the influence of pAg in the second step of sensitization on the performance.

Em-1 was prepared similarly as in Example 1 and after re-dispersion adjusted to a pAg of 6.6. To 300 ml of the resultant emulsion, there was added $1.5\times10^{-6}$ mole ($2.8\times10^{-6}$ mole/mole AgX) of sodium thiosulfate and sulfur sensitization was carried out at 70° C. for 60 minutes. The emulsion was thereafter divided and pAg was adjusted to 7.5, 8.0 and 8.5, respectively. At the same time, the temperature was lowered to 60° C. Thus, sulfur sensitizations were continued and then samples were prepared following the procedure of Example 1. The results are shown in Table 3. Sensitivities are shown as relative values to that of Sample 11 as 100.

TABLE 3

| Sample No. | Second step of sensitization | Total of sensitization time | Sensitivity | Fog |
|---|---|---|---|---|
| 11 (This invention) | pAg 7.5 | 100 min. | 100 | 0.08 |
| 12 (This invention) | pAg 8.0 | 110 min. | 89 | 0.11 |
| 13 (Control) | pAg 8.5 | 110 min. | 73 | 0.17 |

As apparently seen from the Table 3, when pAg is increased higher than the appropriate value, the performance reached is lowered. Particularly, increase of fog becomes greater. The example in which pAg of 6.6 was maintained was omitted here, but it is slightly lower in fog as compared with Sample 12. Thus, it is necessary to control pAg so that it is not increased too much. Also in this case, improvements with respect to reproducibility of sulfur sensitization as well as the shelf-stability under high temperature conditions were recognized, proving that these samples have the favorable effects of this invention.

EXAMPLE 5

One liter of a 1 mole/l silver nitrate solution and a 1 mole/l sodium chloride solution were added by means of metering pumps into 700 ml of a 4% aqueous gelatin solution containing 1.8 g of sodium chloride, while controlling the rate of addition to be stepwisely changed, over 78 minutes. During this operation, pAg was controlled to be maintained at 7.6. After completion of addition, desalination and washing with water were conducted according to the same procedures as shown in Example 1, followed by re-dispersion into a gelatin solution, and the volume was made up to 560 ml.

As the next step, 150 ml of this emulsion was sampled and an aqueous solution containing gelatin and sodium chloride was added to adjust the gelatin concentration to 4%, the sodium chloride concentration to 1.2% and the volume to 700 ml. Into this mixture, there were added 732 ml of a 1 mole/l silver nitrate solution and a 1 mole/l sodium chloride solution over 46 minutes, while controlling pAg at 8.0. After desalination and washing with water were conducted according to the methods as shown in Example 1, the emulsion was re-dispersed in a gelatin solution, adjusted to pAg of 6.6 and at the same time adjusted to a volume of 560 ml. As the result of electron microscopic observation, the emulsion was found to have an average crystal size of 0.7 μm. This emulsion is called hereinafter as Em-2.

Then, preparation of a three-colored light-sensitive color photographic material was carried out in the following manner.

On a paper support for photography laminated with a polyethylene containing an anatase type titanium oxide, corona discharging treatment was applied and the following six layers were laid successively thereon by coating to prepare a light-sensitive color photographic material for print. The quantity of each material was represented in terms of an amount per 1 $m^2$ of the light-sensitive material, and silver halide is calculated as silver.

Layer-1

A blue-sensitive emulsion layer containing 0.45 g of a blue-sensitive emulsion (average crystal size: 0.70 μm), 1.47 g of gelatin and 0.4 g of dibutyl phthalate (hereinafter abbreviated as DBP) having dissolved 0.8 g of a yellow coupler (YC-1*) and 0.015 g of a color stain preventing agent (AS-1) therein.

*YC-1: α-(1-benzyl-2,4-dioxo-3-imidazolidinyl)-α-pivalyl-2-chloro-5-[γ-(2,4-di-t-amylphenoxy)-butaneamido]acetanilide Layer-2

A first intermediate layer containing 1.03 g of gelatin and 0.03 g of DBP having dissolved 0.015 g of a color stain preventing agent (AS-1) therein.

Layer-3

A green-sensitive emulsion layer containing 0.40 g of a green-sensitive emulsion (average crystal size: 0.4 μm), 1.85 g of gelatin and 0.34 g of TCP having dissolved 0.63 g of a magenta coupler (MC-1) and 0.015 g of a color stain preventing agent (AS-1) therein.

Layer-4

A second intermediate layer containing 1.45 g of gelatin, 0.22 g of DBP having 0.2 g of a UV-absorber (UV-1*), 0.3 g of a UV-absorber (UV-2**) and 0.05 g of a color stain preventing agent (AS-1) dissolved therein.

*UV-1: 2-(2-hydroxy-3,5-di-t-butylphenyl)-benzotriazole

**UV-2: 2-(2-hydroxy-5-t-butylphenyl)-benzotriazole

Layer-5

A red-sensitive emulsion layer containing 0.30 g of a red-sensitive emulsion (average crystal size: 0.4 μm), 1.6 g of gelatin and 0.3 g of DBP having dissolved 0.42 g of a cyan forming coupler (CC-1*) and 0.005 g of a color stain preventing agent (AS-1) therein.

*CC-1: 2-[2-(2,4-di-t-amylphenoxy)butaneamido]-4,6-dichloro-5-methylphenol

Layer-6

A protective layer containing 1.8 g of gelatin.

The emulsion employed in this Examples was sulfur sensitized according to the following method.

The silver halide emulsion employed in the Layer-1 was prepared by adding $0.71\times10^{-6}$ mole of sodium thiosulfate per mole of silver halide to Em-2, and the first step sensitization was carried out at a pAg of 6.6 and at a temperature of 70° C., followed by the second step sensitization at a pAg of 7.5 and at a temperature of 60° C. Five minutes before termination of the sulfur sensitization, a solution of a sensitizing dye (BS-1*) was added in an amount of $3.0\times10^{-4}$ mole per mole of silver halide, and 1 g of a stabilizer (ST-1) added per mole of silver halide on termination of sensitization. After the addition, a 10% aqueous gelatin solution was added and the mixture was cooled after stirring to be set.

*BS-1: 5-(3-ethyl-2-benzothiazolinilidene)-3-(β-sulfoethyl)rhodanine

The silver halide emulsion employed in the Layer-3 was prepared by adding $2.9\times10^{-6}$ mole of sodium thiosulfate per mole of silver halide to Em-1 of Example 1, and sulfur sensitization was conducted with the same pAg's and temperatures in the respective first and second steps as in the emulsion of Layer-1. Otherwise, the emulsion was prepared by the same method as in Layer-1 except for using $3.0\times10^{-4}$ mole of (GS-1) per mole of silver halide as a sensitizing dye.

The silver halide emulsion employed in the Layer-5 was prepared under the same conditions as in the emulsion in the Layer-3 except that the sensitizing dye was changed to (RS-1**).

**RS-1: 3,3'-di-(β-hydroxyethyl)thiadicarbocyanine bromide

In addition to the aforementioned materials, bis(-vinylsulfonylmethyl)ether was contained as a hardener and saponin as a surfactant.

The sample according to this invention is designated as Sample 14, and Sample 15 was prepared under the same conditions except for replacing the respective layers with a silver chlorobromide emulsion containing 15 mole % of silver chloride with an average crystal size of 0.70 μm (blue-sensitive emulsion layer), a silver chlorobromide emulsion containing 20 mole % of silver chloride with an average crystal size of 0.40 μm (green-sensitive emulsion layer) and a silver chlorobromide emulsion containing 20 mole % of silver chloride with an average crystal size of 0.40 μm (red-sensitive emulsion layer).

Control Sample 16 was also prepared with the use of the same silver halide emulsion as in Sample 14 under entirely the same conditions as in preparation of Sample 14, except that the amount of sodium thiosulfate added was changed to $1\times10^{-5}$ mole in the blue-sensitive emulsion layer, and to $1.5\times10^{-5}$ mole in the green-sensitive and red-sensitive emulsion layers (each per mole of silver halide), the sulfur sensitization conditions changed to pAg=7.6 and a temperature of 60° C. and the conditions for sulfur sensitization were not changed in the course of the operation.

The above three kinds of light-sensitive color photographic materials were subjected to exposure through a color negative film, followed by color development as mentioned in Example 1, whereby good color prints were obtained within one minute for Samples 14 and 16. Substantially no image was obtained in Sample 15. Accordingly, Sample 15 was treated according to the color development (CD-2*) conventionally used in the prior art for 3.5 minutes and compared with Samples 14 and 15 previously obtained, whereby it was confirmed that all of these samples had comparable performances with respect to color reproduction and tone reproduction. Particularly, in Samples 14 and 16, pure colors such as red and green were found to be reproduced even to the higher density portions without lowering in chroma. Thus, it was confirmed that color photographic papers having by far superior performance to the color photographic paper (Sample 15) employing the silver chlorobromide of the prior art can be realized by use of the silver halide emulsion according to this invention.

*CD-2: prepared by modifying CD-1 of the color developer CD-1 by changing adenine to 0 mg and employing 0.5 g of potassium bromide; the temperature is the same as for CD-1.

The results obtained when these samples were exposed and developed after storage under a high temperature condition together with those not stored under a high temperature condition are also set forth in Table 4.

TABLE 4

| | No high temperature storage | | | | | | High temperature storage | | | | | |
|---|---|---|---|---|---|---|---|---|---|---|---|---|
| | Blue | | Green | | Red | | Blue | | Green | | Red | |
| Sample No. | Sensitivity | Fog | Sensitivity | Fog | Sensitivity | Fog | Sensitivity | Fog | Sensitivity | Fog | Sensitivity | Fog |
| 14. This invention | 150 | 0.05 | 145 | 0.03 | 143 | 0.03 | 108 | 0.08 | 105 | 0.06 | 103 | 0.05 |
| 16. Control | 100 | 0.08 | 100 | 0.06 | 100 | 0.04 | 130 | 0.18 | 125 | 0.15 | 120 | 0.10 |

Sensitivities are shown in terms of relative values to that of Sample 16 as 100 in case of no high temperature storage, while in terms of relative values to that of the each sample without the high temperature storage as 100 in case of the high temperature storage.

It can be seen that there can be obtained a light-sensitive material decreased in fog with little fluctuations of fog and sensitivity after storage under higher temperature conditions from the silver halide emulsion according to this invention.

It will readily be understood that the light-sensitive silver halide color photographic material, which has been prepared without any other specific material than those employed in the light-sensitive silver halide color photographic materials using silver chlorobromide of the prior art, can give a good image by the color development within one minute without any change such as elevation of development temperature, can exhibit advantages of silver chloride exhibiting no lowering of chroma even to higher density portions in reproduction of pure colors such as red or green, and, moreover, is improved in the drawbacks of high fog and poor shelf-stability of silver chloride.

We claim:

1. In a process for producing a silver halide emulsion for photography, which comprises (1) precipitation (2) sulfur sensitizing and (3) termination of sulfur sensitizing, the improvement comprising sulfur sensitizing a silver halide emulsion which contains a chloride rich silver halide comprising at least 80 mole % of silver chloride, said sulfur sensitizing comprising at least two sensitizing steps wherein the conditions of at least one of pAg and temperature are different in the first two sensitizing steps; wherein when the temperature of the first and the second sensitizing steps are different, the temperature of said first sensitizing step is higher than the temperature of said second sensitizing step; wherein when the pAg values of the first and the second sensitizing steps are different, the pAg of said second sensitizing step is greater than the pAg of said first sensitizing step; and wherein the transition from said first sensitizing step to said second sensitizing step is at a period when the sensitivity of said silver halide emulsion is up to 50% of the sensitivity after completion of said sulfur sensitizing.

2. The process of claim 1, wherein the temperature of said second sensitizing step is within the range of 30° C. to 80° C. and wherein the temperature of said second sensitizing step is 3° C. to 30° C. less than the temperature of said first sensitizing step.

3. The process of claim 1, wherein the pAg of said second sensitizing step is within the range of 5.7 to 8.4 and wherein the pAg of said second sensitizing step is at least 0.1 greater than the pAg of said first sensitizing step.

4. The process of claim 1, wherein the temperature of said second sensitizing step is within the range of 30° C. to 80° C. and the temperature of said second sensitizing step is 3° C. to 30° C. less than the temperature of said first sensitizing step, and wherein the pAg of said second sensitizing step is within the range of 5.7 to 8.4 and the pAg of said second sensitizing step is at least 0.1 greater than the pAg of said first sensitizing step.

5. The process of claim 1, wherein the silver halide emulsion contains a dye image forming substance.

6. The process of claim 1, wherein the process of sulfur sensitizing employs a sulfur sensitizer in an amount sufficient to provide up to $3\times10^{-3}$ molecules of said sulfur sensitizer per silver ion present on the surface of the silver halide crystals.

7. The process of claim 6, wherein the amount of said sulfur sensitizer is sufficient to provide between $5\times10^{-5}$ to $1\times10^{-3}$ molecules of said sensitizer per silver ion present on the surface of the silver halide crystals.

8. The process of claim 1, further comprising initiating said second sensitizing step when the sensitivity of the silver halide emulsion is up to 25% greater than the sensitivity of the silver halide emulsion before commencement of said sulfur sensitizing.

9. The process of claim 1, wherein the chloride rich silver halide is pure silver chloride.

10. The process of claim 1, wherein said chloride rich silver halide further comprises up to 20 mole % of silver bromide.

11. The process of claim 1, wherein said chloride rich silver halide consists essentially of at least 90 mole % of silver chloride.

12. The process of claim 3, wherein the pAg of the second sensitizing step is in the range of 7.0 to 8.0.

13. The process of claim 4, wherein the pAg of the second sensitizing step is in the range of 7.0 to 8.0.

14. The process of claim 3, wherein the pAg of the second sensitizing step is 0.1 to 1.5 greater than the pAg of the first sensitizing step.

15. The process of claim 4, wherein the pAg of the second sensitizing step is 0.1 to 1.5 greater than the pAg of the first sensitizing step.

16. The process of claim 2, wherein the temperature of the second sensitizing step is between 5° to 20° C. lower than the temperature of the first sensitizing step.

17. The process of claim 4, wherein the temperature of the second sensitizing step is between 5° to 20° C. lower than the temperature of the first sensitizing step.

18. The process of claim 6, wherein the sulfur sensitizer is sodium thiosulfate.

19. The process of claim 1, wherein sulfur sensitizing is conducted in two steps.

20. The process of claim 19, wherein the temperature of said second sensitizing step is within the range of 30° C. to 80° C. and wherein the temperature of said second sensitizing step is 3° C. to 30° C. less than the temperature of said first sensitizing step.

21. The process of claim 19, wherein the pAg of said second sensitizing step is within the range of 5.7 to 8.4 and wherein the pAg of said second sensitizing step is at least 0.1 greater than the pAg of said first sensitizing step.

22. The process of claim 19, wherein the temperature of said second sensitizing step is within the range of 30° C. to 80° C. and the temperature of said second sensitizing step is 3° C. to 30° C. less than the temperature of said sensitizing step, and wherein the pAg of said second sensitizing step is within the range of 5.7 to 8.4 and the pAg of said second sensitizing step is at least 0.1 greater than the pAg of said first sensitizing step.

* * * * *